US006715735B2

(12) United States Patent
Bligh et al.

(10) Patent No.: US 6,715,735 B2
(45) Date of Patent: Apr. 6, 2004

(54) HEAD ASSEMBLY FOR GUARDRAIL EXTRUDER TERMINAL

(75) Inventors: Roger Bligh, Bryan, TX (US); Steve Brown, Dallas, TX (US); Eugene Buth, College Station, TX (US); Hayes E. Ross, College Station, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 09/943,727

(22) Filed: Aug. 31, 2001

(65) Prior Publication Data

US 2002/0066896 A1 Jun. 6, 2002

Related U.S. Application Data

(60) Provisional application No. 60/229,486, filed on Aug. 31, 2000.

(51) Int. Cl.[7] ..... E01F 15/00

(52) U.S. Cl. ..... 256/13.1; 404/6; 404/10

(58) Field of Search ..... 256/13.1; 404/6, 404/7, 8, 9, 10

(56) References Cited

U.S. PATENT DOCUMENTS

| | | | |
|---|---|---|---|
| 79,141 | A | 6/1868 | McFarlin |
| 398,078 | A | 2/1889 | Peterson |
| 446,852 | A | 2/1891 | Davis |
| 629,185 | A | 7/1899 | Arnold |

(List continued on next page.)

FOREIGN PATENT DOCUMENTS

| | | | |
|---|---|---|---|
| AT | 278890 | 2/1970 | ..... E01F/15/00 |
| AU | 603003 | 3/1989 | ..... E01F/13/00 |
| AU | A021844/88 | 11/1990 | |
| DE | 1 916 361 | 3/1963 | |
| DE | 1534526 | 11/1965 | |
| DE | 3708861 | 10/1988 | |
| EP | 0245042 | 4/1987 | |
| EP | 0 245 042 | 11/1987 | ..... E01F/15/00 |
| FR | 77 11540 | 3/1978 | ..... E04H/12/22 |
| FR | 2546932 | 6/1983 | |
| GB | 2023695 A | 1/1980 | |
| LU | 40465 | 10/1961 | |
| LU | 41444 | 5/1962 | |
| WO | 98/50637 | 12/1998 | |
| WO | 00/40805 | 7/2000 | |

OTHER PUBLICATIONS

U.S. patent application Ser. No. 10/308,296 filed Dec. 2, 2002, entitled *Steel yielding Guardrail Support Post* by Alberson, et al.

Notification of Transmittal of The International Search Report, PCT application No. PCT/US03/15002, date of mailing Aug. 14, 2003.

"BEAT Box Beam Bursting Energy Absorbing Terminal", RSI Road Systems, Inc., http://www.roadsystems.com/beat.htm.

(List continued on next page.)

*Primary Examiner*—Lynne H. Browne
*Assistant Examiner*—Ryan M. Flandro
(74) *Attorney, Agent, or Firm*—Baker Botts L.L.P.

(57) ABSTRACT

A guardrail extruder terminal includes a rail feeder chute associated with a downstream end of the guardrail extruder terminal. The terminal also includes an impact portion associated with an upstream end thereof. The impact portion is coupled to the upstream end of the rail feeder chute and includes an impact plate positioned to face oncoming traffic, a first side member coupled to the impact plate and positioned on a roadway side of the guardrail extruder terminal, and a second side member coupled to the impact plate and positioned opposite the first side member. The impact portion may include a top plate and a bottom plate, each being coupled between the first and second side members. The top and bottom plates each have a traffic side edge positioned to face a roadway that is approximately flush with a traffic side of the rail feeder chute.

27 Claims, 5 Drawing Sheets

U.S. PATENT DOCUMENTS

| | | | | |
|---|---|---|---|---|
| 1,329,492 | A | | 2/1920 | Babcock |
| 1,335,302 | A | | 3/1920 | Stout |
| 1,473,118 | A | | 11/1923 | Miller-Masury |
| 1,677,796 | A | | 7/1928 | Parks |
| 2,089,929 | A | | 8/1937 | Brickman et al. |
| 2,091,195 | A | | 8/1937 | Dennebaum |
| 2,123,167 | A | | 7/1938 | Cain |
| 2,135,705 | A | | 11/1938 | Florance |
| 2,146,445 | A | | 2/1939 | Russert et al. |
| 2,309,238 | A | | 1/1943 | Corey |
| 2,321,988 | A | | 6/1943 | Brickman |
| 2,735,251 | A | | 2/1956 | Dlugosch |
| 2,776,116 | A | | 1/1957 | Brickman |
| 3,308,584 | A | | 3/1967 | Graham |
| 3,332,666 | A | | 7/1967 | Gray |
| 3,349,531 | A | | 10/1967 | Watson |
| 3,385,564 | A | | 5/1968 | Persicke |
| 3,417,965 | A | | 12/1968 | Gray |
| 3,450,233 | A | | 6/1969 | Massa |
| 3,499,630 | A | | 3/1970 | Dashio |
| 3,519,301 | A | | 7/1970 | Somnitz |
| 3,521,917 | A | | 7/1970 | King |
| 3,567,184 | A | | 3/1971 | Yancey |
| 3,606,222 | A | | 9/1971 | Howard |
| 3,617,076 | A | | 11/1971 | Attwood |
| 3,637,244 | A | | 1/1972 | Strizki |
| 3,643,924 | A | | 2/1972 | Fitch |
| 3,680,448 | A | | 8/1972 | Ballingall et al. |
| 3,693,940 | A | | 9/1972 | Kendall et al. |
| 3,711,881 | A | | 1/1973 | Chapman et al. |
| 3,768,781 | A | | 10/1973 | Walker et al. |
| 3,776,520 | A | | 12/1973 | Charles et al. |
| 3,820,906 | A | | 6/1974 | Katt |
| 3,846,030 | A | | 11/1974 | Katt |
| 3,912,404 | A | | 10/1975 | Katt |
| 3,925,929 | A | | 12/1975 | Montgomery |
| 3,951,556 | A | | 4/1976 | Strizki |
| 3,967,906 | A | | 7/1976 | Strizki |
| 3,972,510 | A | * | 8/1976 | Dougherty ..... 256/11 |
| 3,981,486 | A | | 9/1976 | Baumann |
| 4,063,713 | A | | 12/1977 | Anolick et al. |
| 4,071,970 | A | | 2/1978 | Strizki |
| 4,126,403 | A | | 11/1978 | Sweeney et al. |
| 4,183,695 | A | | 1/1980 | Wilcox |
| 4,236,843 | A | | 12/1980 | Chisholm |
| 4,269,384 | A | | 5/1981 | Saeed et al. |
| 4,278,228 | A | | 7/1981 | Rebentisch et al. |
| 4,295,637 | A | | 10/1981 | Huleck |
| 4,330,106 | A | | 5/1982 | Chisholm |
| 4,389,134 | A | | 6/1983 | Colas |
| 4,399,980 | A | | 8/1983 | van Schie |
| 4,490,062 | A | | 12/1984 | Chisholm |
| 4,583,716 | A | | 4/1986 | Stephens et al. |
| 4,607,824 | A | | 8/1986 | Krage et al. |
| 4,646,489 | A | | 3/1987 | Feller et al. |
| 4,655,434 | A | | 4/1987 | Bronstad |
| 4,678,166 | A | | 7/1987 | Bronstad et al. |
| 4,729,690 | A | | 3/1988 | Lavender et al. |
| 4,784,515 | A | | 11/1988 | Krage et al. |
| 4,815,565 | A | | 3/1989 | Sicking et al. |
| 4,838,523 | A | | 6/1989 | Humble et al. |
| 4,852,847 | A | | 8/1989 | Pagel |
| 4,926,592 | A | | 5/1990 | Nehls |
| 4,928,446 | A | | 5/1990 | Alexander, Sr. |
| 4,928,928 | A | | 5/1990 | Buth et al. |
| 4,986,687 | A | | 1/1991 | Ivey |
| 5,022,782 | A | | 6/1991 | Gertz et al. |
| 5,078,366 | A | | 1/1992 | Sicking et al. |
| 5,203,543 | A | | 4/1993 | Fleury |
| 5,214,886 | A | | 6/1993 | Hughron |
| 5,286,137 | A | | 2/1994 | Cicinnati et al. |
| 5,391,016 | A | | 2/1995 | Ivey et al. |
| 5,407,298 | A | | 4/1995 | Sicking et al. |
| 5,484,217 | A | | 1/1996 | Carroll et al. |
| 5,503,495 | A | | 4/1996 | Mak et al. |
| 5,547,309 | A | | 8/1996 | Mak et al. |
| 5,657,966 | A | | 8/1997 | Cicinnati |
| 5,664,905 | A | | 9/1997 | Thompson et al. |
| 5,765,811 | A | | 6/1998 | Alberson et al. |
| 5,775,675 | A | | 7/1998 | Sicking et al. |
| 5,797,591 | A | | 8/1998 | Krage |
| 5,924,680 | A | | 7/1999 | Sicking et al. |
| 5,931,448 | A | | 8/1999 | Sicking et al. |
| 5,957,435 | A | | 9/1999 | Bronstad |
| 5,988,598 | A | | 11/1999 | Sicking et al. |
| 6,065,894 | A | | 5/2000 | Wasson et al. |
| 6,109,597 | A | | 5/2000 | Sicking et al. |
| 6,129,342 | A | | 10/2000 | Bronstad |
| 6,210,066 | B1 | | 4/2001 | Dent |
| 6,220,575 | B1 | | 4/2001 | Lindsay et al. |
| 6,244,571 | B1 | | 6/2001 | Reid et al. |
| 6,254,063 | B1 | | 7/2001 | Rohde et al. |
| 6,260,827 | B1 | | 7/2001 | Sicking et al. |
| 6,299,141 | B1 | | 10/2001 | Lindsay et al. |
| 6,308,809 | B1 | | 10/2001 | Reid et al. |
| 6,347,904 | B1 | | 2/2002 | Knighton |
| 6,398,192 | B1 | | 6/2002 | Albritton |
| 6,409,156 | B2 | | 6/2002 | Dent |
| 6,416,041 | B1 | | 7/2002 | Sicking et al. |
| 6,435,761 | B1 | | 8/2002 | Bligh et al. |
| 6,488,268 | B1 | | 12/2002 | Albritton |
| 2001/0048101 | A1 | | 12/2001 | Bligh et al. |
| 2002/0179894 | A1 | | 12/2002 | Albritton |

OTHER PUBLICATIONS

International Preliminary Examination Report for PCT/US99/30463, Apr. 24, 2001.

International Preliminary Examination Report for PCT/US98/09029, Jul. 12, 2000.

International Search Report for PCT/US99/30463, Apr. 28, 2000.

International Search Report for PCT/US98/09029, Sep. 1, 1998.

Written Opinion for PCT/US99/30463, Nov. 22, 2000.

Written Opinion for PCT/US98/09029, Mar. 29, 2000.

ER–2000 The Future of Highway Safety—SYRO (Printed in Dec. 1990; revised Oct. 1992.

Bronstad et al., *Modified Breakaway Cable Terminals for Guardrails and Median Barriers*, Research Results Digest, NCHRP, Transportation Research Board, Digest 12, May 1978.

*Breakaway Metal Post for Highway Guardrail End Treatments* U.S. patent application Ser. No. 09/074,496 filed May 7, 1998 James R. Albritton (091078.0554).

*Breakaway Support Post for Highway Guardrail End Treatments* U.S. patent application Ser. No. 09/358,017 filed Jul. 19, 1999 James R. Albritton (091078.0774).

U.S. patent application Publication No. US 2001/0013596 dated Aug. 16, 2001 for U.S. patent application Ser. No. 09/410,635 filed Oct. 1, 1999 by Dean L. Sicking et al.

U.S. patent application Publication No. US 2002/0007994 dated Jan. 24, 2002 for U.S. patent application Ser. No. 09/935,949 filed Aug. 23, 2001 by John D. Reid et al. Assignee: Safety By Design Company.

* cited by examiner

HEAD ASSEMBLY FOR GUARDRAIL EXTRUDER TERMINAL

CROSS-REFERENCE TO RELATED APPLICATIONS

This application claims the priority of U.S. Provisional Patent Application No. 60/229,486 filed Aug. 31, 2000.

BACKGROUND OF THE INVENTION

1. Field of the Invention

The invention relates to guardrail extruder devices used with guardrail installations. In particular aspects, the invention relates to the design of impact head assemblies for such devices.

2. Description of the Related Art

Guardrail extruder terminals are a popular and effective end treatment for guardrail installations. During an end-on impact to a guardrail end, a guardrail extruder terminal will flatten and bend a corrugated rail member and extrude the flattened portion away from the roadway. Terminals of this type are described in U.S. Pat. Nos. 5,078,366 and 4,928,928.

SUMMARY OF THE INVENTION

The present invention provides an improved head assembly for a guardrail extruder terminal device. An exemplary head assembly is described that is lighter and more effective than prior art head assemblies. The exemplary head assembly provides a throat that receives a corrugated guardrail. In preferred embodiments, the throat is a squeezing throat that is narrower at the upstream end than at the downstream end. The squeezing throat compresses a rail and flattens it. A curved plate contacts the rail and extrudes it away from the head assembly. The throat is constructed from a pair of side members. In a first described embodiment, the first side member is an elongated, S-shaped plate while the second side member is a short curved plate. Alternative head constructions are described wherein the throat is constructed from side members that are formed of flat plates rather than curved plates. The flat plates may be tapered such that the upstream end of the throat is narrower than the downstream end. Alternatively, the flat plates may be non-tapered wherein the squeezing is accomplished through combined action of the throat and curved deflector plate.

The impact plate of the head assembly is vertically elongated and presents upper and lower overhangs that assist with vehicle engagement. In addition, the impact plate is provided with flanges on either side to help stiffen the plate. The head is also asymmetrical and streamlined. When the impact head is mounted on a rail member, the central point of impact is off-center with respect to the axis of the head.

DETAILED DESCRIPTION OF THE PREFERRED EMBODIMENTS

Figure 1:
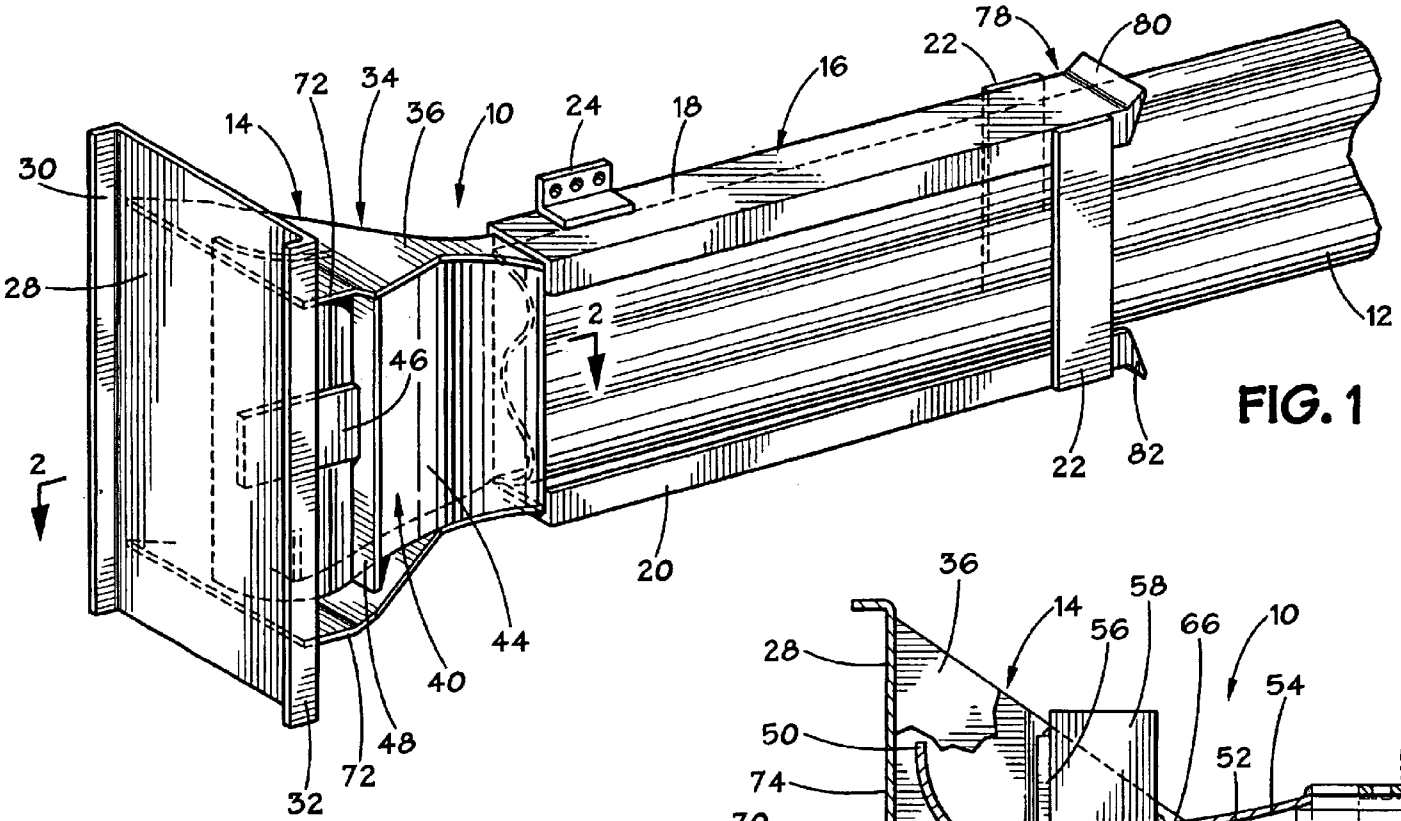
FIG. 1 is an isometric view of an exemplary guardrail extruder terminal head constructed in accordance with the present invention.

FIGS. 1–5 illustrate a first improved head assembly 10 used for a guardrail extruder terminal of the type described generally in U.S. Pat. Nos. 5,078,366 and 4,928,928. The general operation of guardrail extruder terminal devices is described in those two patents and they are incorporated herein by reference. The head assembly 10 is shown (in FIG. 1) positioned on the end of a corrugated, or W-beam, guardrail 12.

The head assembly 10 generally includes an impact portion 14 and an elongated rail feeder chute 16. The rail feeder chute 16 surrounds the upstream portion of the rail member 12 and is made up of an upper, U-shaped channel member 18 and a lower, U-shaped channel member 20 which are secured in a spaced relation from one another by strap plates 22. L-shaped brackets 24, 16 are affixed to the upper and lower channels members 18, 20, respectively.

The impact portion 14 of the head assembly 10 has, at its upstream end, an impact plate 28. The impact plate 28 is bent on either lateral side to present flanges 30, 32. The flanges 30, 32 lend strength to the impact plate 28, stiffen it, and assist with engagement of an impacting vehicle.

The impact plate 28 is secured by welding to a rail receiving portion 34 of the impact portion 14. The rail receiving portion 34 includes a top plate 36 and a bottom plate 38. The top and bottom plates 36, 38 are affixed by welding to left and right side members 40, 42, respectively. The left side member 40 consists of a curved plate 44, horizontal connecting plate 46, and a lateral brace 48. The lateral brace 48 is welded to the curved plate 44, and the connecting plate 46 is welded to brace 48 in an abutting relation. It is noted that the curved plate 44 has an "S" shape such that it provides an upstream first curved portion 50 and a downstream second curved portion 52 at curves slightly in the opposite direction from the first curved portion 50. The brace 48 is affixed to the curved plate 44 in between the first and second curves 50,52. The right side member 42 includes a short curved plate 54 with vertical and horizontal braces 56,58, respectively that are welded to the plate 54 to stiffen it. It is noted that, in this embodiment, the side plates 40,54 are curved. The side plate 54 is, unlike prior art designs significantly shorter in length than the plate 40, as measured from upstream to downstream. This difference in length is due to the fact that there is no forward curved portion of plate 54 that would correspond to the curved portion 50 of the longer plate 40.

It is noted that the horizontal brace 58 extends some distance outwardly from the right side of the head 10. This is done deliberately as the horizontal brace 58 is intended to engage and break the support post 60 during a vehicular impact to the impact plate 28 of the impact head 10 that moves the head 10 downstream upon the rail member 12.

Figure 4:
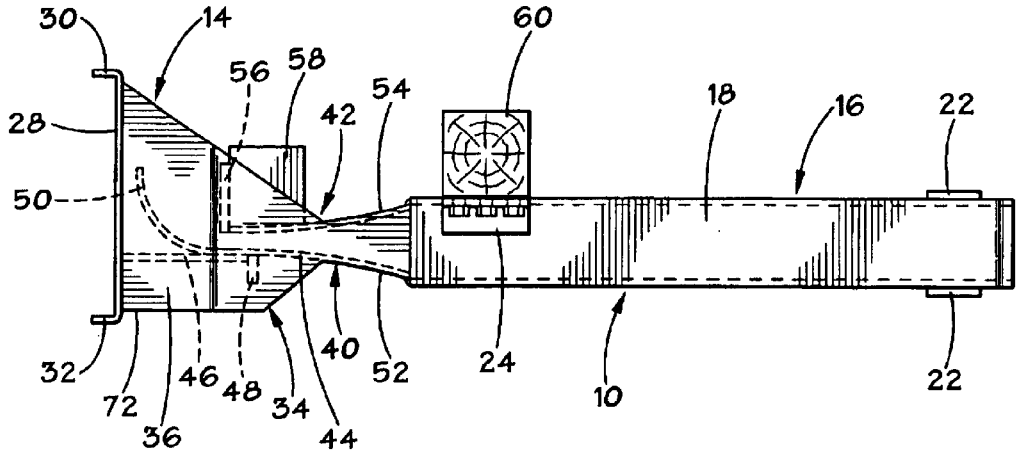
FIG. 4 is a plan view of the head of FIGS. 1–3 shown affixed to a support post.
Figure 5:
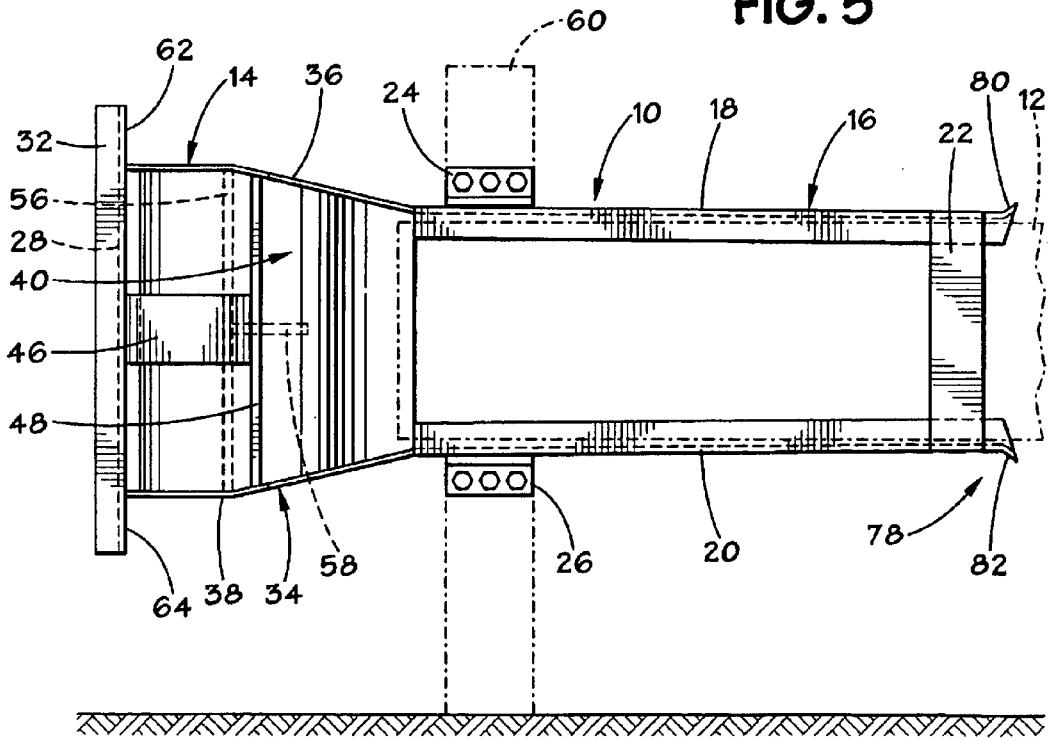
FIG. 5 is a side view of the head shown in FIG. 4.

FIGS. 4 and 5 illustrate the impact head 10 having been affixed to a support post 60 by connectors (not shown) that are disposed through the brackets 24, 26.

It is further noted that the impact plate 28 is vertically elongated, thereby extending both above and below the rail receiving portions of the impact portion 14, as shown by reference numerals 62, 64 in FIG. 5. These overhangs permit the impact head 10 to be easily engaged by either the high bumper of trucks, SUV's and other taller vehicles and the low set bumpers of smaller cars impacting in a frontal manner, as well as engaging the vehicle frame or rocker panel to reduce vehicle intrusion when the upstream end of the head 10 is impacted by a vehicle in a sideways manner.

Figure 2:
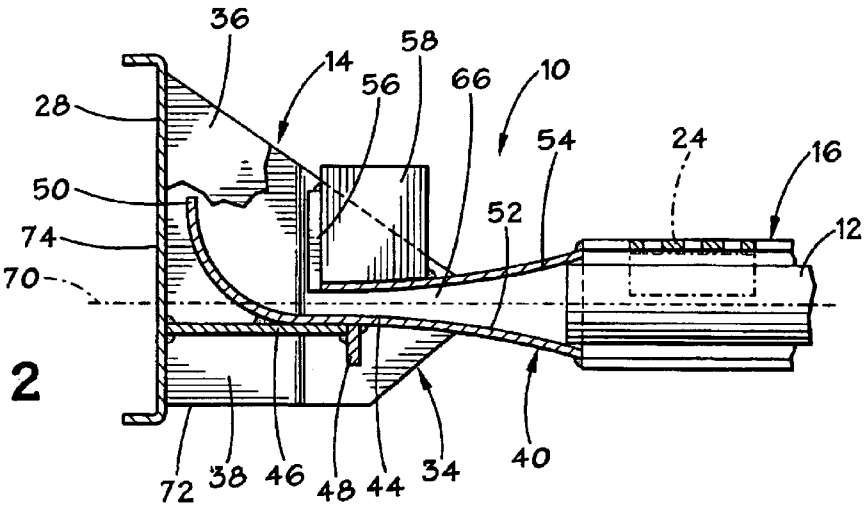
FIG. 2 is a plan, cross-sectional view of the head taken along the lines 2—2 in FIG. 1.
Figure 3:
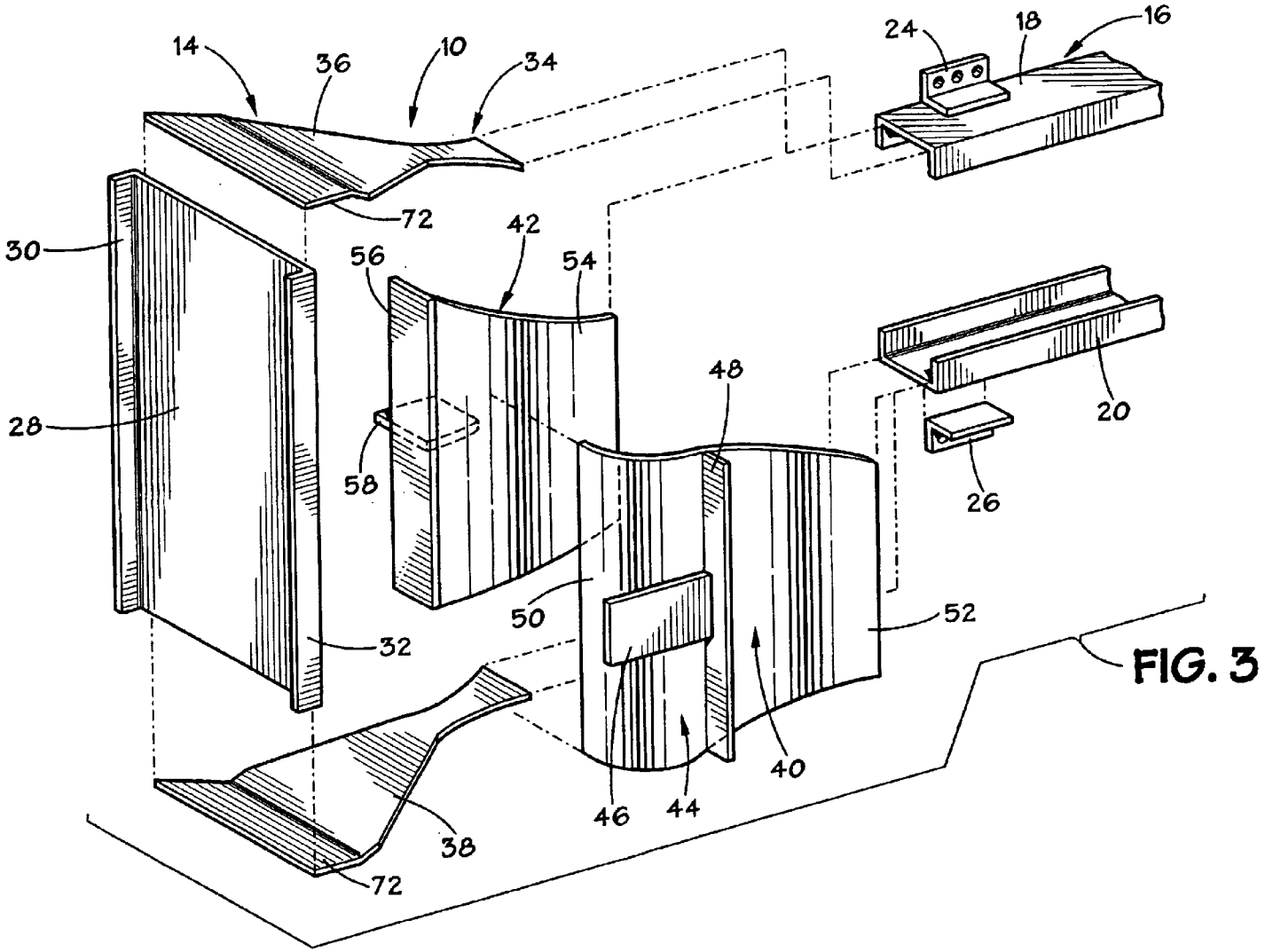
FIG. 3 is an exploded view of the head shown in FIGS. 1–2.

In a preferred embodiment, when the head 10 is assembled, the curved plate 44 and short curved plate 54 are secured in a spaced relation from one another to form a squeezing throat 66, best seen in FIG. 2. The throat 66 narrows in width as it approaches the upstream end of the impact head 10. During collision wherein the impact head 10 is impacted by a colliding vehicle (not shown), the throat 66 squeezes and flattens the rail member 12 as the head 10 is pushed downstream by the vehicle onto the rail member 12. The first curved portion 50 bends the flattened portion of the rail member 12 and extrudes it to the side of the head 10.

There are a number of important differences between the inventive impact head 10 and the guardrail extruder heads described in U.S. Pat. Nos. 5,078,366 and 4,928,928. First, the portion of the head 10 that is used to bend and extrude the flattened portion of the rail 12 consists only of a single curved surface, specifically, the rail contacting surface of portion 50 on curved plate 44. Thus, an opening is provided opposite the portion 50 upstream of the end of the small curved plate 54. In prior arrangements, a pair of curved portions were provided by two plate members that formed a narrow opening. Elimination of one curved portion, i.e. the most downstream curved portion) reduces the extrusion force required to extrude the rail member 12 and potentially improves the trajectory of the extruded rail as it departs the head 10. The required extrusion force is reduced at least because friction created by the removed downstream curved portion has been eliminated.

Also, as FIGS. 2 and 4 illustrate, the inventive head 10 provides a reduced and streamlined profile along the traffic side (i.e., the side of the head 10 that will be directed toward a roadway). FIG. 2 illustrates a central longitudinal axis 70 that is taken along the center line of the rail member 12. The traffic side of the head 10 (shown at the bottom portion of FIGS. 2 and 4) does not extend as far from the axis 70 as the opposite side of the head 10 (shown at the top portion of FIGS. 2 and 4). This streamlining is permitted by the fact that the top and bottom plates 36, 38 each have a flattened traffic side edge 72 as opposed to the outwardly extending, generally triangular shape of the opposite sides of those plates. The head 10 is always installed on the rail 12 so that the "traffic" side is facing roadway traffic. This streamlined design ensures that the head 10 does not extend outwardly into to the stream of traffic, thereby reducing the frequency of impacts by passing vehicles and the associated maintenance costs. The flattened traffic side edge 72 should lie approximately flush with the strap plates 22 or other portions of the feeder chute 16, or else extend only an inch or two beyond those components in the direction of the traffic lane. This "flush-side" feature helps ensure that the head 10 is less likely to be knocked off of the rail member 12 by a reverse end impact where a vehicle impacts the head from the downstream direction.

It is also noted, particularly with reference to FIG. 2, that the center of impact for the head (shown at around 74) is not aligned with axis 70 of the rail 12. This non-symmetrical design actually improves the function of the head 10 during a collision. Rather than distributing the forces of the impact substantially equally to either side of the head, as in prior designs, the force is primarily transmitted via connecting plate 46 and brace 48 to the curved plate 44. Thus, the connecting plate 46 and brace 48 serve as the axis of force transmission for the head 10. The curved plate 44 is the portion of the head 10 that works to bend and extrude the flattened rail member 12. Because impact force upon the impact plate is transmitted directly to the side member 44 via the axis of force transmission, the head 10 is more efficient in collapsing the rail 12 wherein the exterior of the housing played a greater role in transmitting impact forces.

The impact head 10 of the present invention is advantageous because it has a substantially lighter weight and mass than prior art impact heads. The inventive impact heads typically weigh around 170 pounds versus 260 pounds for many prior art heads. The reduction in weight and results in improved performance for the rail terminal since a lighter head has less inertial resistance by the head during an impact. Initial movement of the impact head and extrusion of the rail member 12 will be performed with less resistance. In addition there is less of a jolting impact to a colliding vehicle due to the reduced weight of the head. The reduction in weight and mass results from a number of changes over prior art heads, including the use of thinner metals for fashioning of the head, the removal of a largely unnecessary external housing, and the removal or change in size of various plates making up the head.

Figure 6:
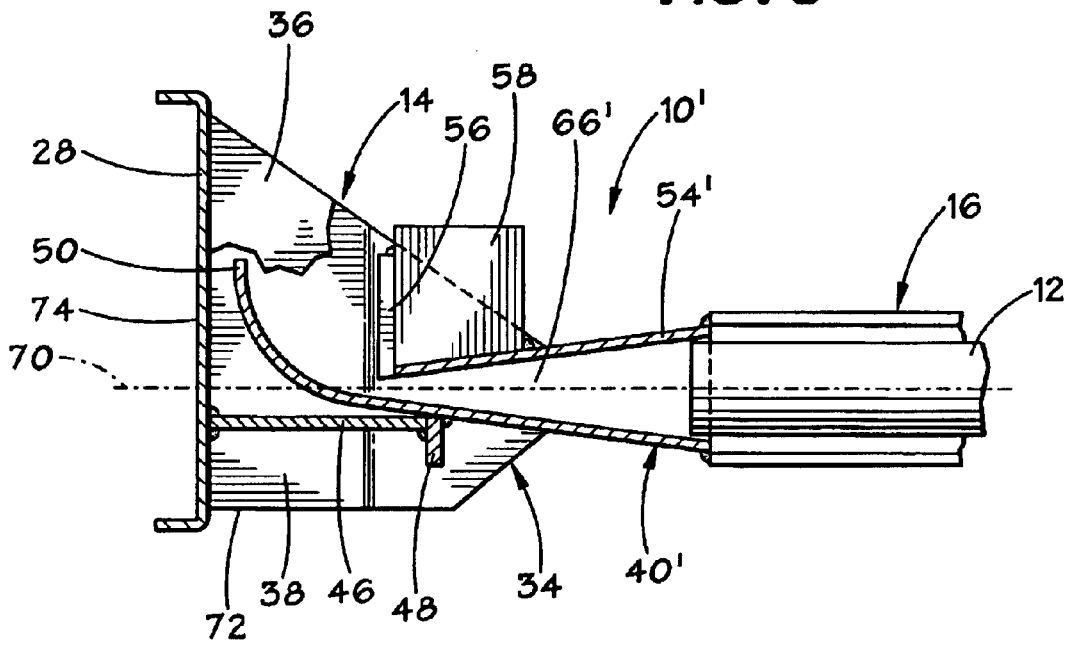
FIG. 6 is a plan, cross-sectional view of an alternative head having a throat with side members that are substantially flat and angled relative to each other.
Figure 7:
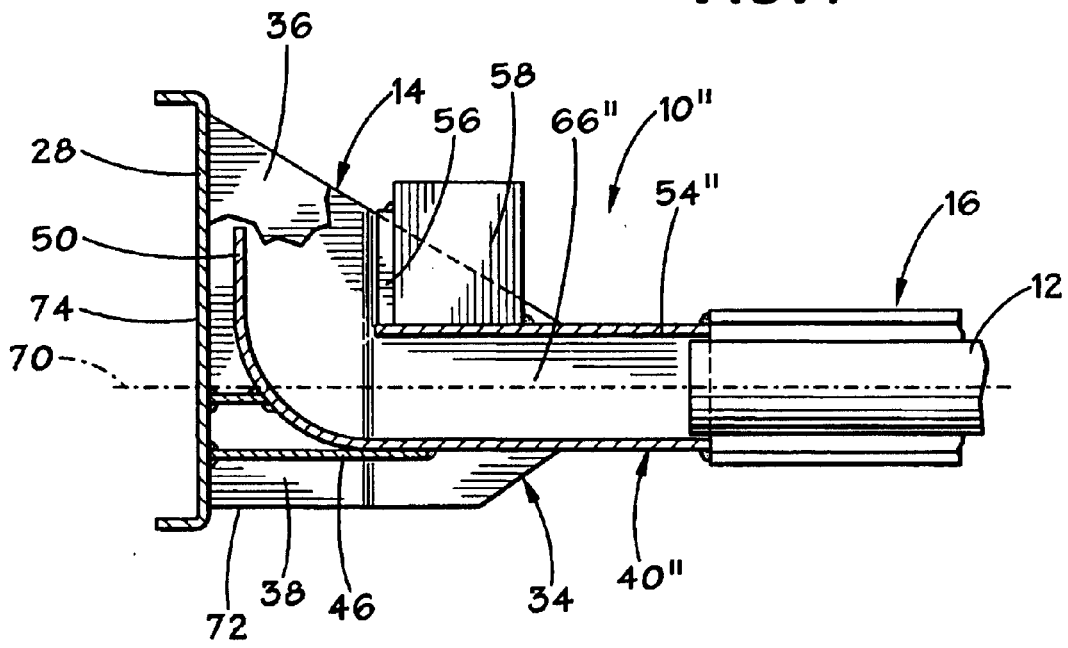
FIG. 7 is a plan, cross-sectional view of a further alternative head having a throat with side members that are substantially flat and parallel to each other.

Turning now to FIGS. 6 and 7, there are shown alternative heads 10' and 10". The heads 10' and 10" are similar in many respects of construction and operation to the head 10 already described except where indicated otherwise. Therefore, like components between the two embodiments are numbered alike. Head 10' has left and right side plates 40' and 54' that form a throat 66'. The plates 40' and 54' provide essentially straight, flat sidewalls for the throat 66'. As can be seen, the throat 66' narrows in width as it approaches the upstream end of the head 10. Head 66" has a throat 66" that is formed from side member plates 40" and 54". The throat 66" is essentially of a constant width along its length as the two side members 40", 54" lie substantially parallel to each other along the length of the throat 66".

Figure 8:
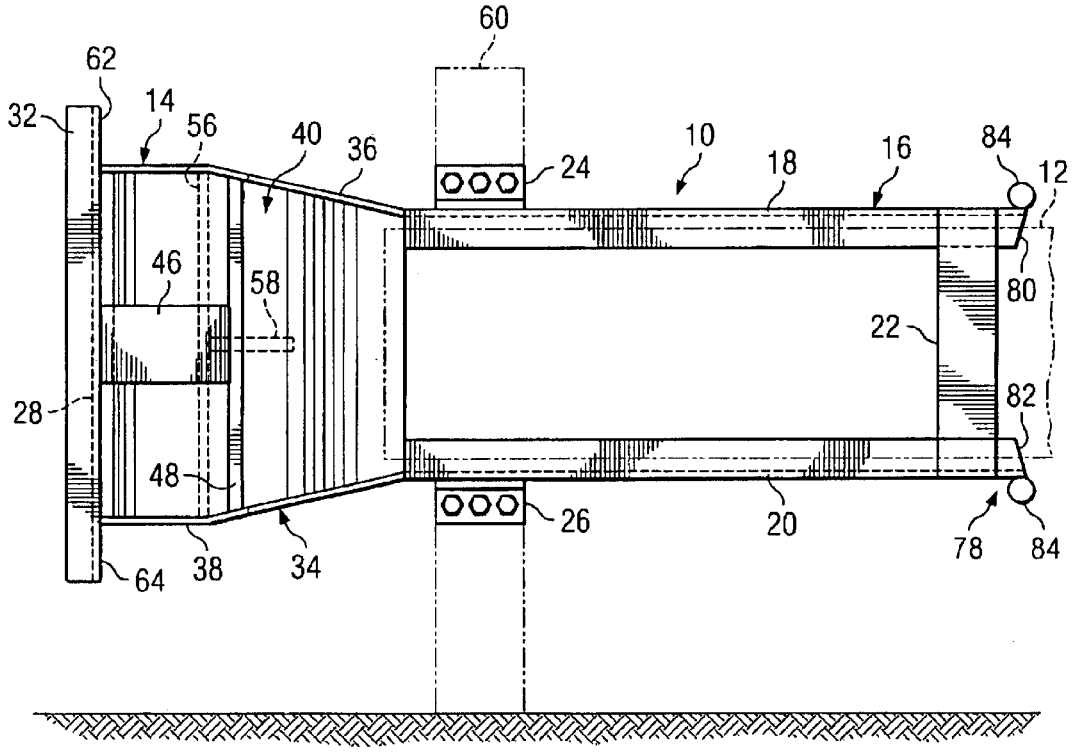
FIG. 8 is an isometric illustration of an guardrail head having an exemplary feeder chute bumper device.

FIG. 8 illustrates a further feature of the invention wherein a feeder chute bumper device is incorporated into the impact head. With reference once again to FIGS. 1 and 5, it may be seen that the impact head 10 has a flared downstream end 78 on the feeder chute 16. The use of a flared end, such as end 78 is preferred because it assists in ease of placement of the head 10 onto the rail member 12. This flared end 78 provides upper and lower extreme downstream edge portions 80, 82 that are formed to present an acute angle and, thus, are somewhat sharp. During an end-on impact to the head 10, the edge portions 80, 82 tend to impact the support posts as the head is pushed downstream along the rail by the impacting vehicle. While the presence of such edge portions 80, 82 is not normally a problem when wooden support posts are used, it becomes a problem when metal support posts are used. For example, when steel wide flange support posts are used, the sharp edge portions 80, 82 may actually cut the flanges of the support post downstream of the head 10. When this occurs, the support post may pull the head 10 downwardly and, thus, resist further travel of the head 10. This is undesirable. FIG. 8 depicts a means of preventing that outcome. Pipe or round metal stock members 84 are secured by welding to the edge portions 80, 82 so as to provide a blunt, rounded impacting portions to the downstream end 78 of the head 10. The pipe or round stock members 84 preferably have a length that is the same as the width of the edge portions 80, 82.

While the invention has been shown or described in only some of its forms, it should be apparent to those skilled in the art that it is not so limited, but is susceptible to other various changes without departing from the scope of the invention.

What is claimed is:

1. A head assembly for use with a guardrail installation, comprising:

a rail feeder chute, comprising:

a first side portion disposed on a traffic side of the head assembly, and a second side portion disposed opposite the traffic side of the head assembly, the first and second side portions being generally parallel with each other and being generally parallel with a central, longitudinal axis of the rail feeder chute;

the first and second side portions being configured to receive a rail member therebetween;

an upstream end;

a downstream end having upper and lower edge portions that form respective acute angles with the central, longitundinal axis;

each of the upper and lower edge portions terminating adjacent to and being coupled with respective rounded members that extend perpendicular to the central, longitudinal axis and the first and second side portions; and wherein the respective rounded members extend further downstream than the upper and lower edge portions, the rounded members providing blunt, rounded termination points to the rail feeder chute at the downstream end, during impact with support posts of the guardrail installation; and an impact portion coupled to the upstream end of the rail feeder chute and comprising:

an impact plate positioned to face oncoming traffic, the impact plate having a greater height than width, an upper overhang extending upwardly, and a lower overhang extending downwardly;

top and bottom members forming a coupling between the rail feeder chute and the impact plate;

first and second side members cooperating to form a throat configured to receive the rail member as it is forced through the impact portion during a collision between an automobile and the impact plate;

the first side member being positioned adjacent the traffic side of the head assembly and including a curved portion that extends away from the traffic side as the first member extends away from the rail feeder chute, the first side member being configured to direct the rail member away from the roadway during an end-on collision;

the second side member being positioned opposite the traffic side of the head assembly and terminating at a vertical brace that extends generally perpendicular to the central, longitudinal axis of the rail feeder chute;

the top and bottom members each having a traffic side edge positioned to face a roadway, the traffic side edge being approximately parallel with the central, longitudinal axis of the rail feeder chute; and a connecting plate coupled between the impact plate and the first portion of the first side member, the connecting plate providing an axis of force transmission for the head assembly, wherein the axis of force transmission is offset from the central, longitudinal axis of the head assembly.

2. The head assembly of claim 1, wherein the impact portion further comprises a horizontal plate coupled to the second side member and the vertical brace, and extending some distance from the second side member in a direction away from the roadway.

3. The head assembly of claim 1, wherein the horizontal plate is configured and positioned to engage and break a support post of the guardrail installation, during a collision.

4. The head assembly of claim 1, wherein the first side member has a substantially S-shape.

5. The head assembly of claim 1, wherein portions of the first and second side members that form the throat are substantially flat.

6. The head assembly of claim 1, wherein portions of the first and second side members that form the throat are substantially parallel.

7. A head assembly for use with a guardrail installation, comprising:

a rail feeder chute having a first side portion disposed on a traffic side of the head assembly, and a second side portion disposed opposite the traffic side of the head assembly, the first and second side portions being generally parallel with each other and being generally parallel with a central, longitudinal axis of the rail feeder chute;

the first and second side portions being configured to receive a rail member therebetween; and an impact portion being coupled with an upstream end of the rail feeder chute and comprising:

top and bottom members forming a coupling between the rail feeder chute and an impact plate;

first and second side members cooperating to form a throat configured to receive the rail member as it is forced through the impact portion during a collision;

the first side member being positioned adjacent the traffic side of the head assembly and including a curved portion that extends away from the traffic side as the first member extends away from the rail feeder chute; and the second side member being positioned opposite the traffic side of the head assembly and terminating at a vertical brace that extends generally perpendicular to the central, longitudinal axis of the rail feeder chute.

8. The head assembly of claim 7, wherein the rail-feeder chute further comprises:

an upstream end;

a downstream end having upper and lower edge portions that form respective acute angles with the central, longitundinal axis;

each of the upper and lower edge portions terminating adjacent to and being coupled with respective rounded members that extend perpendicular to the central, longitudinal axis and the first and second side portions; and wherein the respective rounded members extend further downstream than the upper and lower edge portions, the rounded members providing blunt, rounded termination points to the rail feeder chute at the downstream end, during impact with support posts of the guardrail installation.

9. The head assembly of claim 7, wherein the top member and the bottom member include respective traffic side edges positioned on the traffic side, each traffic side edge comprising an angled portion disposed at an angle to the central, longitudinal axis, and a straight portion that extends approximately parallel with the central, longitudinal axis, and wherein the straight portions are longer than the angled portions.

10. The head assembly of claim 7, wherein the top member and the bottom member are each coupled with the first and second side members, the top and bottom members each having respective traffic side edges positioned on the traffic side, the traffic side edges being approximately parallel with the central, longitudinal axis.

11. The head assembly of claim 7, wherein the top member and the bottom member are each coupled with the first and second side members, the top and bottom members each having respective traffic side edges positioned on the traffic side, the traffic side edges being approximately flush with the first side portion of the rail feeder chute.

12. The head assembly of claim 7, wherein the impact plate is positioned such that a vertical axis of the impact plate is horizontally offset from the central, longitudinal axis of the rail feeder chute.

13. The head assembly of claim 7, wherein the impact portion further comprises a connecting plate coupled between the impact plate and the first side member, the connecting plate providing an axis of force transmission for the head assembly, wherein the axis of force transmission is offset from a central longitudinal axis of the head assembly.

14. The head assembly of claim 7, wherein the impact portion further comprises a horizontal plate coupled to the vertical brace and extending beyond the vertical brace in a direction away from the roadway, the horizontal plate configured to engage and break a support post of the guardrail installation, during a collision.

15. The head assembly of claim 7, wherein the impact plate is rectangular, and includes a long dimension that is disposed vertically, and a short dimension that is disposed horizontally, the long dimension being substantially longer than the short dimension and the impact plate extending substantially above and substantially below the rail feeder chute.

16. The head assembly of claim 7, wherein respective straight portions of the first and second side members are approximately equidistant over a length of the throat.

17. A guardrail extruder terminal comprising:

a rail feeder chute associated with a downstream end of the guardrail extruder terminal, the rail feeder chute configured to receive a rail member therein; and an impact portion associated with an upstream end of the guardrail extruder terminal, the impact portion coupled to the upstream end of the rail feeder chute and comprising:

an impact plate positioned to face oncoming traffic;

a first side member coupled to the impact plate;

a second side member coupled to the impact plate; and a force transmitting member coupled between the impact plate and the first side member, the force transmitting member positioned to provide an axis of force transmission for the guardrail extruder terminal, wherein the axis of force transmission is not aligned with a central longitudinal axis of the guardrail extruder terminal;

a squeezing throat having an entrance and an exit located between the impact plate and the rail feeder chute, the squeezing throat formed by a portion of the first side member and the second side member;

wherein the first side member includes a rail-bending portion extending beyond the exit of the squeezing throat and curving away from a roadway side of the guardrail extruder terminal and configured to direct the rail member away from the roadway during an end-on collision; and wherein the second side member does not extend beyond the exit of the squeezing throat.

18. A guardrail extruder terminal comprising:

a rail feeder chute associated with a downstream end of the guardrail extruder terminal, the rail feeder chute configured to receive a rail member therein; and an impact portion associated with an upstream end of the guardrail extruder terminal, the impact portion coupled to the upstream end of the rail feeder chute and comprising:

an impact plate positioned to face oncoming traffic;

a first side member coupled to the impact plate;

a second side member coupled to the impact plate; and a force transmitting member coupled between the impact plate and the first side member, the force transmitting member positioned to provide an axis of force transmission for the guardrail extruder terminal, wherein the axis of force transmission is not aligned with a central longitudinal axis of the guardrail extruder terminal; and wherein the impact portion further comprises a top plate and a bottom plate both coupled between the first and second side members, the top and bottom plates each having a traffic side edge positioned to face a roadway, the traffic side edge being approximately flush with a traffic side of the rail feeder chute.

19. A guardrail extruder terminal comprising:

a rail feeder chute associated with a downstream end of the guardrail extruder terminal, the rail feeder chute configured to receive a rail member therein; and an impact portion associated with an upstream end of the guardrail extruder terminal, the impact portion coupled to the upstream end of the rail feeder chute and comprising:

an impact plate positioned to face oncoming traffic;

a first side member coupled to the impact plate;

a second side member coupled to the impact plate; and a force transmitting member coupled between the impact plate and the first side member, the force transmitting member positioned to provide an axis of force transmission for the guardrail extruder terminal, wherein the axis of force transmission is not aligned with a central longitudinal axis of the guardrail extruder terminal; and wherein the impact portion further comprises a horizontal brace coupled to the second side member and extending some distance from the second side member in a direction away from a roadway, the horizontal brace configured to engage and break a support post during a collision.

20. A guardrail extruder terminal, comprising:

a rail feeder chute associated with a downstream end of the guardrail extruder terminal, the rail feeder chute configured to receive a rail member therein; and an impact portion associated with an upstream end of the guardrail extruder terminal, the impact portion coupled to the upstream end of the rail feeder chute and comprising:

an impact plate positioned to face oncoming traffic;

a first side member coupled to the impact plate and positioned on a roadway side of the guardrail extruder terminal;

a second side member coupled to the impact plate and positioned opposite the first side member; and a top plate and a bottom plate both coupled between the first and second side members, the top and bottom plates each having a traffic side edge positioned to face a roadway, the traffic side edge being approximately flush with a traffic side of the rail feeder chute.

21. The guardrail extruder terminal of claim 20, wherein the impact portion further comprises a connecting plate coupled between the impact plate and the first side member, the connecting plate providing an axis of force transmission for the guardrail extruder terminal, wherein the axis of force transmission is offset from a central longitudinal axis of the guardrail extruder terminal.

22. The guardrail extruder terminal of claim 20, wherein the impact portion further comprises:

a squeezing throat having an entrance and an exit located between the impact plate and the rail feeder chute, the squeezing throat formed by a portion of the first side member and the second side member;

wherein the first side member includes a rail-bending portion extending beyond the exit of the squeezing throat and curving away from the roadway side of the guardrail extruder terminal and configured to direct the rail member away from the roadway during an end-on collision; and wherein the second side member does not extend beyond the exit of the squeezing throat.

23. The guardrail extruder terminal of claim 20, wherein the rail-feeder chute further comprises:

an upstream end;

a downstream end having upper and lower edge portions that form an acute angle; and a rounded member coupled to each edge portion.

24. The guardrail extruder terminal of claim 20, wherein the impact portion further comprises a top plate and a bottom plate both coupled between the first and second side members, the top and bottom plates each having a traffic side edge positioned to face a roadway, the traffic side edge being approximately flush with a traffic side of the rail feeder chute.

25. The guardrail extruder terminal of claim 20, wherein the impact portion further comprises a horizontal brace coupled to the second side member and extending some distance from the second side member in a direction away from a roadway, the horizontal brace configured to engage and break a support post during a collision.

26. The guardrail extruder terminal of claim 20, wherein the impact plate is vertically elongated.

27. The guardrail extruder terminal of claim 20, wherein the first side member has a substantially S-shape.

* * * * *